US008561797B2

(12) United States Patent
Paschke et al.

(10) Patent No.: US 8,561,797 B2
(45) Date of Patent: Oct. 22, 2013

(54) PACKAGING CONTAINER

(75) Inventors: Brian Dennis Paschke, Toronto (CA); Todd Andrew Wood, Guelph (CA); Ingve Holmung, Toronto (CA); Kevin Roy Sugden, Toronto (CA); Di Tao, Toronto (CA)

(73) Assignee: BlackBerry Limited, Waterloo, CA (US)

( * ) Notice: Subject to any disclaimer, the term of this patent is extended or adjusted under 35 U.S.C. 154(b) by 0 days.

(21) Appl. No.: 12/903,450

(22) Filed: Oct. 13, 2010

(65) Prior Publication Data

US 2012/0091030 A1 Apr. 19, 2012

(51) Int. Cl.
*B65D 73/00* (2006.01)

(52) U.S. Cl.
USPC ..... 206/470; 206/775; 206/471

(58) Field of Classification Search
USPC ..... 206/587, 586, 591, 454, 465, 521.5, 206/470, 467, 461, 462, 463, 482, 487, 1.5, 206/734, 733, 765, 585, 583, 471; 108/33; 160/43; 211/7, 8, 50, 113
See application file for complete search history.

(56) References Cited

U.S. PATENT DOCUMENTS

| | | | | | |
|---|---|---|---|---|---|
| 905,615 | A | * | 12/1908 | Wilson | 206/521.5 |
| 2,115,181 | A | * | 4/1938 | Shapiro | 206/521.5 |
| 3,241,660 | A | * | 3/1966 | Cathcart, Jr. et al. | 206/780 |
| 3,487,921 | A | | 1/1970 | Barth et al. | |
| 3,685,649 | A | * | 8/1972 | Diehl | 206/45.24 |
| 3,908,826 | A | * | 9/1975 | Faller | 206/463 |
| 4,549,654 | A | * | 10/1985 | Tiesman | 206/486 |
| 4,669,610 | A | * | 6/1987 | Lindsey et al. | 206/320 |
| 4,852,743 | A | | 8/1989 | Ridgeway | |
| 5,386,911 | A | * | 2/1995 | Payne | 206/583 |
| 5,582,293 | A | * | 12/1996 | Kay | 206/457 |
| 6,039,495 | A | | 3/2000 | Zimmerman et al. | |
| 6,367,624 | B1 | | 4/2002 | Szczepanski et al. | |
| 6,581,777 | B2 | * | 6/2003 | Thibault | 206/780 |
| 6,622,867 | B2 | * | 9/2003 | Menceles | 206/771 |
| 6,814,227 | B2 | * | 11/2004 | Seligman et al. | 206/82 |
| 7,882,950 | B2 | * | 2/2011 | Nazari | 206/488 |
| 7,992,710 | B2 | * | 8/2011 | Jimenez et al. | 206/362.2 |
| 2003/0019785 | A1 | | 1/2003 | Sarasjoki | |
| 2004/0099560 | A1 | * | 5/2004 | Christen | 206/461 |
| 2006/0266672 | A1 | * | 11/2006 | Young | 206/776 |
| 2007/0199862 | A1 | | 8/2007 | Kim et al. | |
| 2008/0169218 | A1 | | 7/2008 | Andre et al. | |
| 2010/0155277 | A1 | | 6/2010 | Koch | |

OTHER PUBLICATIONS

"Jawbone Bluetooth Headset Packaging" (URL: http://www.mobiles.co.uk/images/jaw-bone-big.jpg).

(Continued)

*Primary Examiner* — Luan K Bui
*Assistant Examiner* — Rafael Ortiz
(74) *Attorney, Agent, or Firm* — Moffat & Co.

(57) ABSTRACT

A packaging container for a device comprising an enclosure assembled from separable front and back transparent shells the assembled shells defining a cavity for housing the device. A transparent insert configured with outer edges for abutting at least three inner walls of the enclosure and having an aperture conformed to a silhouette of the device for engaging and retaining the device around its periphery and in a generally central position in the cavity so that at least a back, front, top and sides of the device may be directly viewed within the cavity without visual obstruction.

8 Claims, 6 Drawing Sheets

(56) References Cited

OTHER PUBLICATIONS

"iPhone Packaging" (URL: http://www.cultofmac.com/steve-jobs-awarded-patent-for-iphone-packaging/13435).
Motorola Bluetooth Headset Packaging (URL: http://images.htcpedia.com/review_imgs/cd/ea/51fb9dbe8fa609af12579606b85f.jpg).
"BlueAnt Bluetooth Headset Packaging" (URL: http://www.legitreviews.com/images/reviews/747/BlueAnt_Z9i_box.jpg).
"Jabra Bluetooth Headset Packaging" (URL: http://www.blueunplugged.com/xsdbimgs/bt5010-box.jpg).
"iPod Packaging" (URL: http://www.blogcdn.com/www.tuaw.com/media/2006/09/nanopackage.jpg).
Canadian Patent Application No. 2,717,526, Office Action dated Jul. 12, 2012.

* cited by examiner

PACKAGING CONTAINER

FIELD OF THE DISCLOSURE

The present disclosure relates generally to packaging and more particularly to packaging container for transportation and display of small form factor devices such as wireless headsets.

BACKGROUND

Devices such as Bluetooth headsets for use with wireless devices are almost ubiquitous. Given that the headsets are worn in proximity to and are visible around a users face, users are particularly concerned with aesthetic features of the device and sometimes wish to carefully view visual features of the device before purchasing. Accordingly, manufacturers and merchants are required to package and display these devices on the store shelves in such a manner that the consumer is able to readily view the product from all directions.

One solution is to use clear blister packaging, however this is somewhat outdated and limited in that it does not provide a full view of the product and sometimes requires the merchant to have a sample product removed from the blister pack for view. Other types of packaging comprise a box having a reflective back surface within the box; a transparent cover is placed over the product so that the purchaser may view the front of the product through the transparent cover and the rear of the product off the reflecting surface. A disadvantage with this is that the rear of the part is sometimes obscured and not clearly visible in the reflective surface.

Other packaging uses a clear plastic box with the product suspended in the box by a mechanical fastener, which is typically made of clear plastic or the like. A lower portion of the clear plastic box is usually enclosed by a graphic sleeve to hide accessories for the product, such as a charger, instruction booklets, a USB cable and the like. The mechanical fastener is visible and can detract from the visual appearance of the product.

There is therefore a need for improved packaging that minimizes the appearance of any visible mechanical connectors to support the product in the display packaging container for mounting the product in a most suitable orientation, so that the consumer is able to view the product from most orientations, while creating an illusion of the product floating in the packaging container.

BRIEF DESCRIPTION OF THE DRAWINGS

The present system and method will be better understood with reference to the drawings in which.

DETAILED DESCRIPTION OF THE DRAWINGS

Figure 1A:
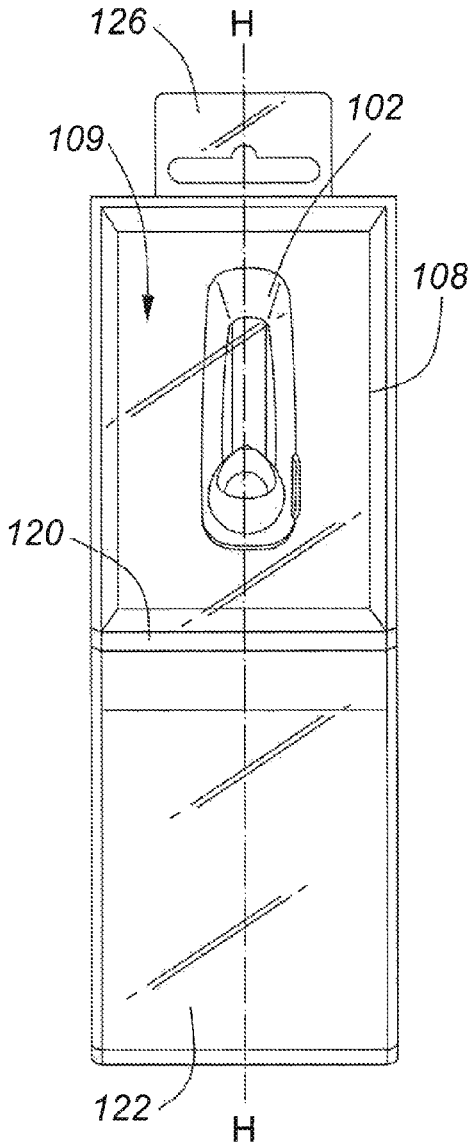
FIGS. 1*a-e* show a schematic diagram of respective back, front, side top and bottom views of a container according to an embodiment of the present matter.
Figure 1B:
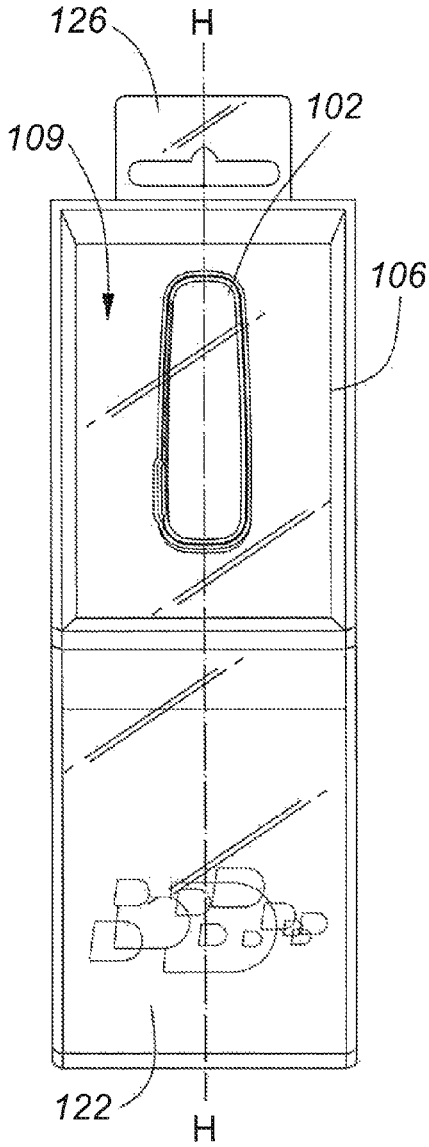
Figure 1C:
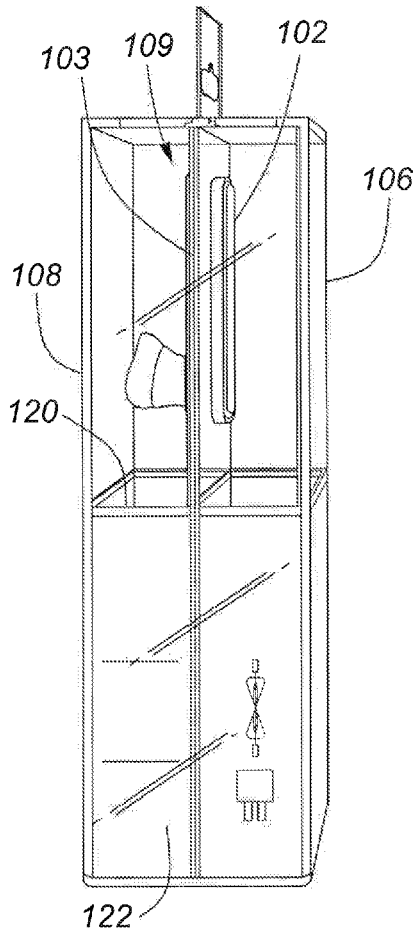
Figure 1D:
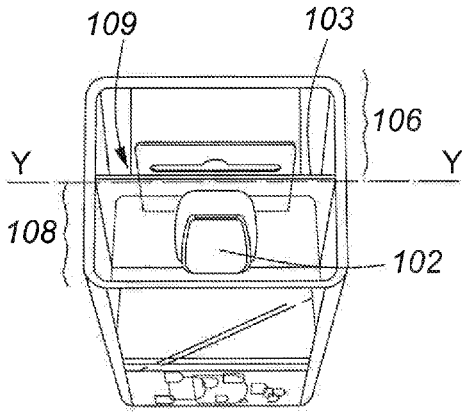
Figure 1E:
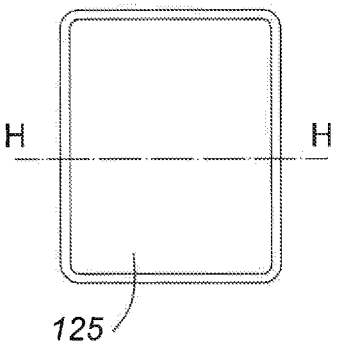

In accordance with an embodiment of the present matter there is provided a packaging container for a device comprising an enclosure assembled from separable front and back transparent shells the assembled shells defining a cavity for housing the device; and a transparent insert configured with outer edges for abutting at least three inner walls of the enclosure and having an aperture conformed to a silhouette of the device for engaging and retaining the device around its periphery and in a generally central position in said cavity so that at least a back, front, top and sides of the device may be directly viewed within the cavity without visual obstruction.

In accordance with a further embodiment there is provided an insert for a packing container comprising a first L-shaped insert having a first aperture on one portion thereof; and a second L-shaped insert having a second aperture, the first and second apertures conformed to a silhouette of a device for engaging and retaining the device around its periphery when the L-shaped inserts are abutted together.

In a further aspect a base portion of the inserts include rail projections formed respectively on three edges for engaging and registering corresponding grooves formed on inner front, back and side walls of the packing container.

Referring to FIGS. 1*a-e* there is shown a schematic diagram of respective back, front, side top and bottom views of a container 100 for packaging a device 102 for transport and display according to an embodiment of the present matter. The container 100 includes an enclosure having a transparent front shell portion 106 and a transparent back shell portion 108. The two portions fit together to form a cavity 107 for enclosing the device 102 and are the shell portions are sized so that the entire periphery of the device 102 may be spaced from the inner walls of the cavity. The device 102 is held in this spaced relationship within the cavity 107 by a transparent insert 109 configured to fit snugly between walls of the cavity 107 and having a cut-out or aperture 111 conformed to a silhouette of the device 102 within which the device 102 is retained. The insert 109 and the shells are formed of a transparent plastics material; the insert in particular may be made of a semi rigid plastics material with similar optical properties as the shells. The insert 109 is designed to retain the device 102 in a somewhat upright position while creating a visual effect of the device floating within the enclosure. The device may thus be clearly viewed within the enclosure substantially from all sides of the container. Furthermore this visual effect is enhanced by the insert 109 being positioned within the cavity with outer edges of the insert aligned with the seam 103 formed at an interface between the coupled shells.

Figure 2:
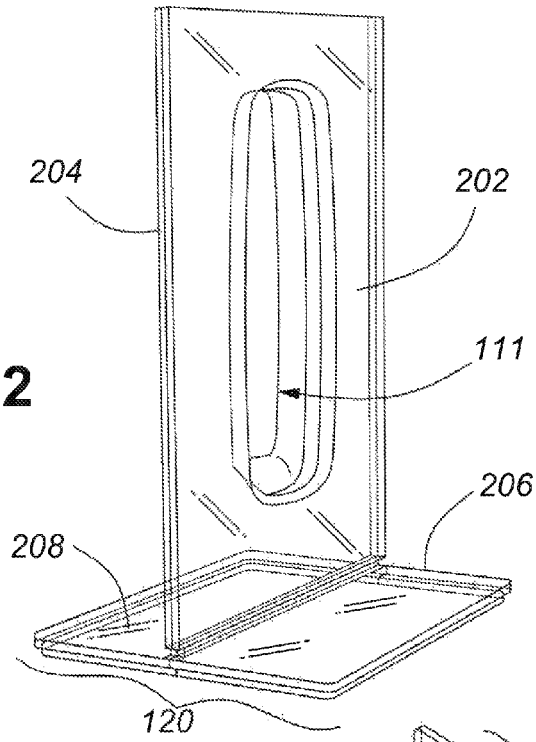
FIG. 2 illustrates a perspective view of an assembled insert according to an embodiment of the present matter.

An example of the insert 109 is shown in FIG. 2 where there is illustrated a perspective view of the insert 109. In the illustrated example the insert 109 has an inverted T-shape assembled from a pair of L-shaped members 202, 204, shown respectively in FIG. 3*a* and FIG. 3*b*. The L-shaped members comprise a respective planar base 206, 208 and respective planar upright 210, 212 portions. The inserts 202, 204 when assembled abut each other along a surface of their upright portions 210, 212 with the base sections 206, 208 extending away from each other in opposite directions thus appearing, in profile, as an inverted T-shape as shown more clearly in FIG. 2.

As mentioned earlier, the apertures or cut-outs 111 are located somewhat centrally in the upright portions 210, 212, and are sized to a silhouette of the device 102. In the illustrated example, edges 114, 116 around the apertures are cupped or slightly curved towards the base section to conform to the periphery of the device 102. When assembled, the slightly curved edges form a groove around the aperture 111 to partially cradle and trap the device between the opposing cupped edges of the inserts when facing surfaces of the upright portions are compressed together, as is more clearly seen by referring to FIG. 4*a* where there is shown a cross-sectional view along a plane H-H of the container 100 and FIG. 4*b* which shows an expanded view in a region of FIG. 4*a* where the inserts abut the periphery of the device 102.

Thus the two L-shaped inserts when brought and held together in an aperture-to-aperture alignment captures and immobilizes the device sandwiched between the peripheral edges of the apertures. Furthermore, it may be seen that the gentle curving of the apertures in the edge regions 416, 418 to cup only the device periphery reduces visual distortion when observing the periphery of the device and thereby also serve to enhance the appearance of floating.

The base portions 206, 208 of the inserts 110, 112 include rail formations 214 and 216 respectively on three of the base portion edges such that the rail projections engage and lock into corresponding grooves on the inner front, back and side walls of the enclosure shells.

As previously described outer edges of the inserts 109 are configured to engage inner walls of the enclosure 104 such that the upright portions engage inner top and inner side walls of the shells 104, 106 so that the edges of inserts 110, 112 appear imperceptible to the eye further contributing to the appearance of the device floating within the cavity. This visual effect is still further enhanced by closely conforming the apertures to the periphery or silhouette of the device.

Figure 4A:
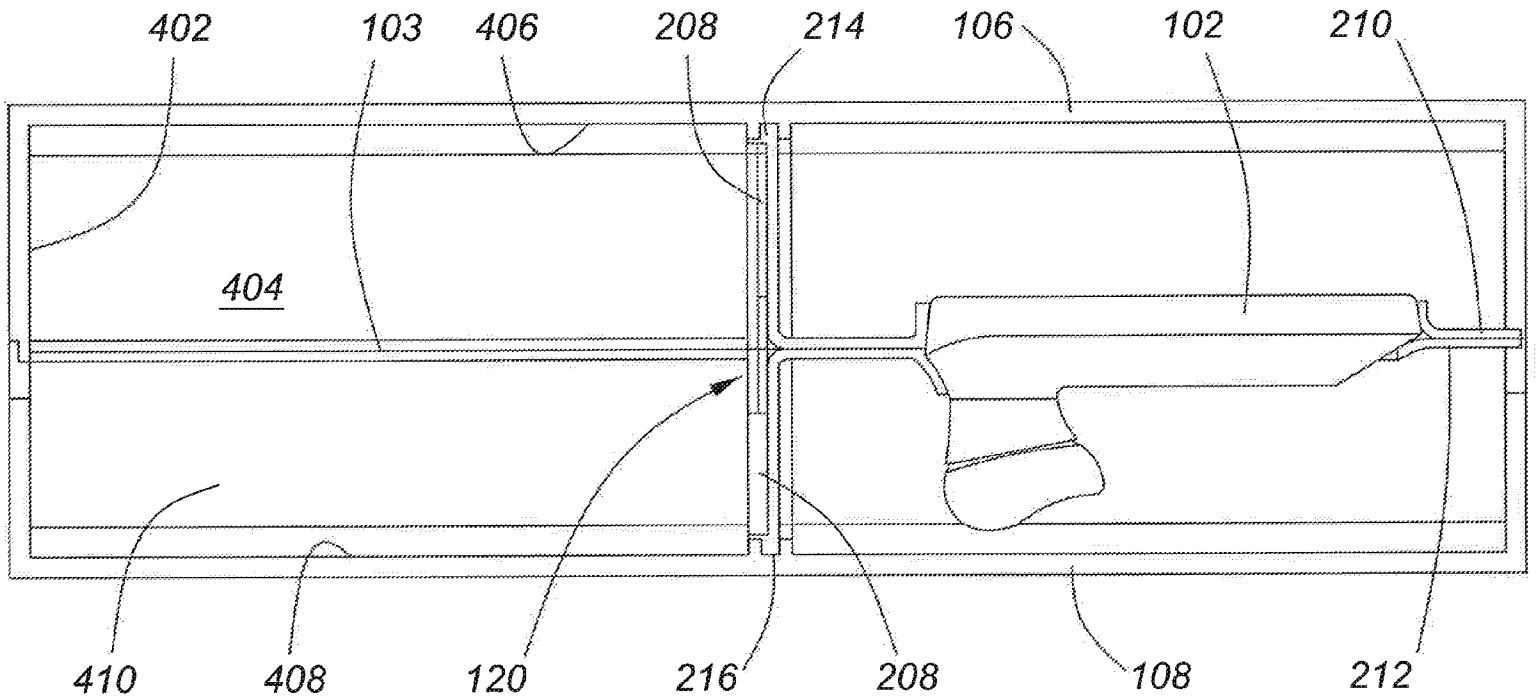
FIG. 4*a* illustrates a cross sectional view on a section H-H of FIG. 1.
Figure 4B:
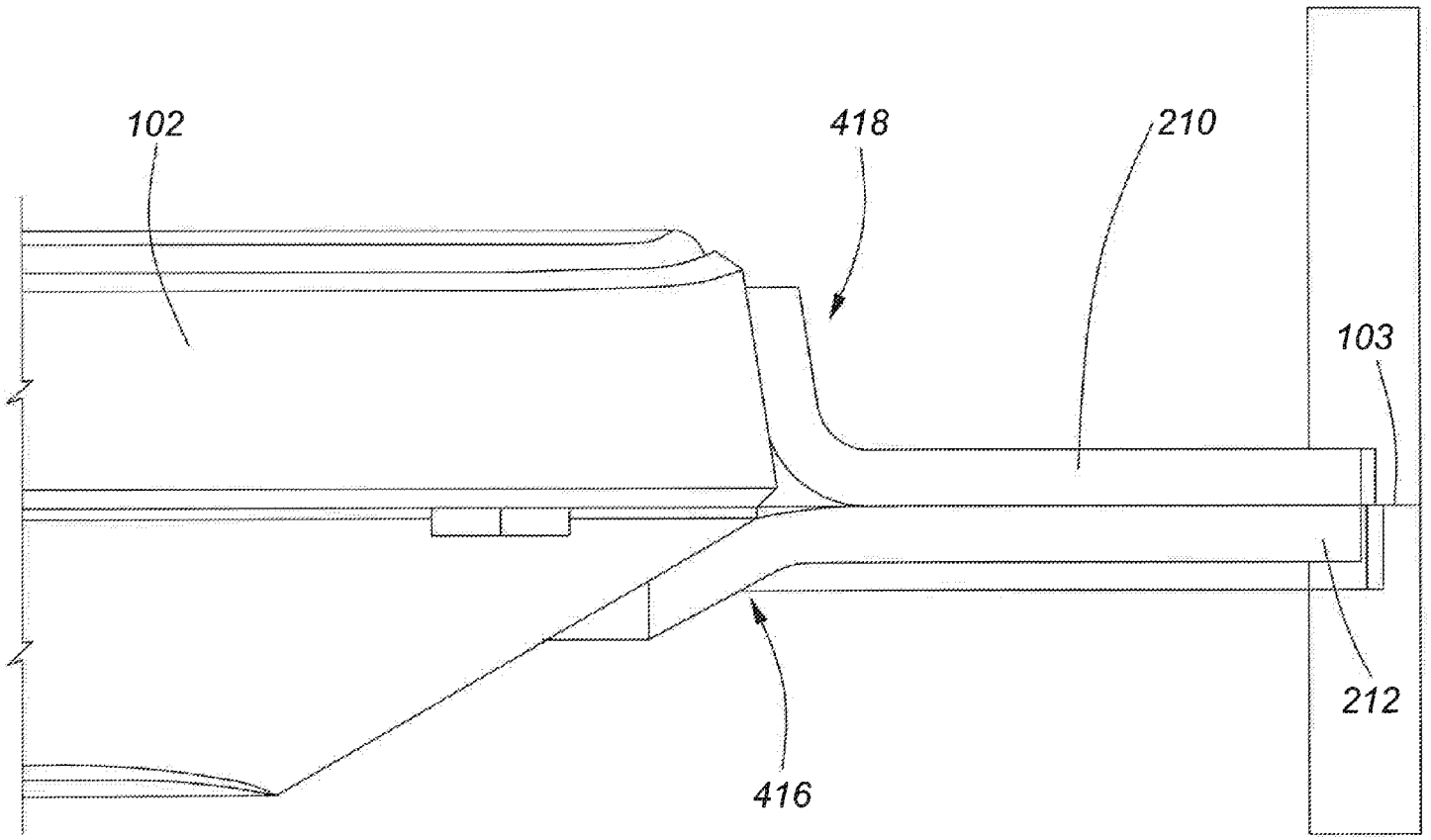
FIG. 4*b* shows an expanded view in a region of FIG. 4*a*.

Referring back to the illustrated embodiment of FIG. 1 and the cross sectional view in FIG. 4*a* the base portion 120 is spaced from a bottom wall 402 of the container 100 to divide the container into two compartments. An upper compartment defining said cavity for housing the device and a lower compartment for storage. Accordingly in this embodiment, the base portion defines a compartment 404 between the bottom 402, front 406, back 408 and side 410 walls of the shells 106, 108 and the base portion 120. A sleeve 122 or box may be placed in the interior of the lower compartment and may be marked with identifying words or pictures to convey information to the consumer about the device inside the container. Additionally, accessory items (not shown) for use with a product contained in packaging can be stored inside this compartment. For example, power cords, earphones, USB connectors, and the like, or warranties and instruction manuals can be stored inside the sleeve. The sleeve may be shaped to conform to the shape of base and is sized to fit snugly in the interior of the compartment. In one embodiment, the sleeve can be opaque so that any items stored within are not visible although the sleeve could be transparent as well.

In the illustrated embodiment, the container 100 is somewhat box-like with the front and back shells 106, 108 identically shaped having side walls that project one toward the other when assembled. Each side wall terminates in an edge at an open end of the shell which abuts a corresponding seat of the other shell when the shells 108, 106 are assembled. As may be seen the edges on each shell terminate substantially in the same plane Y-Y when assembled into the container 100. Furthermore, the edges of the upright portions abut the inside of the shells in the plane where the shell edges terminate thus the edges of the inserts also appear imperceptible to the eye and appear to be part of the shell further enhancing the visual effect of the device floating.

Figure 5A:
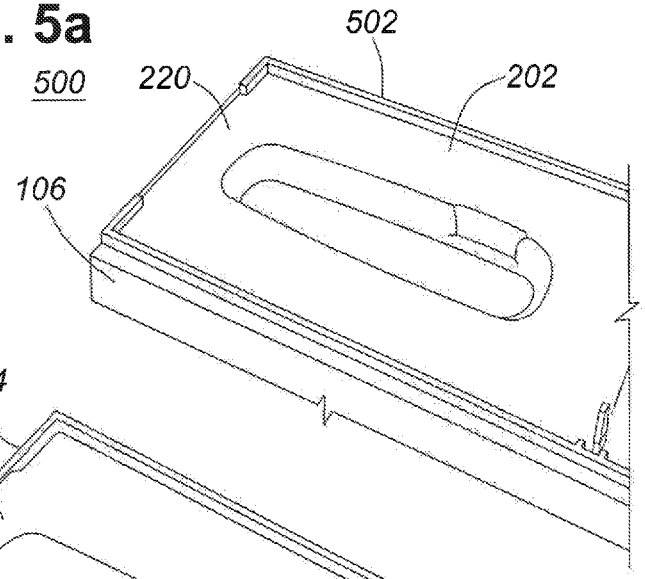
FIGS. 5*a-b* illustrates perspective view of inserts assembled onto a corresponding shell according to an embodiment of the present matter.
Figure 5B:
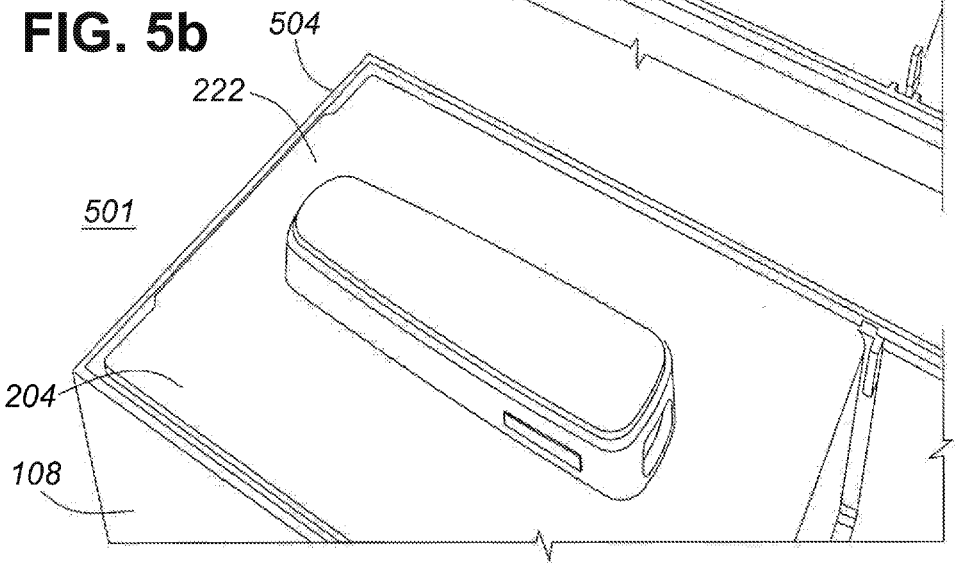

Referring to FIGS. 5*a* and 5*b* there is shown respectively assemblies 500 and 501 of front and back shells 106, 108 and their respective inserts, edges of the shells 106, 108 are recessed into the respective terminal edges of the shell side walls to form a ledge 502, 504 so that a half lap joint is formed along the interface between the shells when assembled together. Specifically a seat of the ledge 504 is formed from the inner side of one of the shells 108 and a corresponding seat of ledge 502 is formed from an outer side of the other shell 106.

Figure 3A:
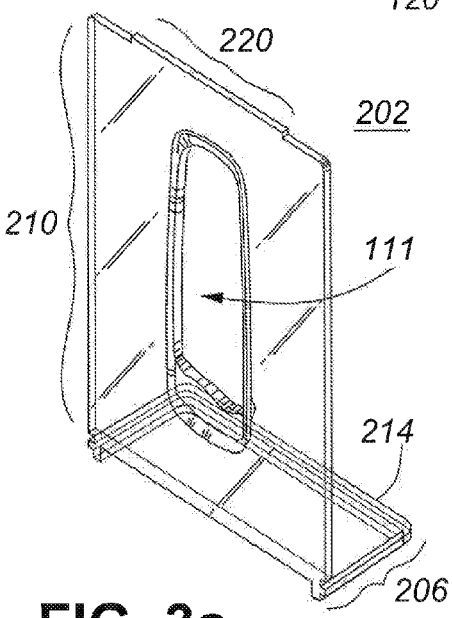
FIGS. 3*a-b* illustrates respective L-shaped members according to an embodiment of the present matter.
Figure 3B:
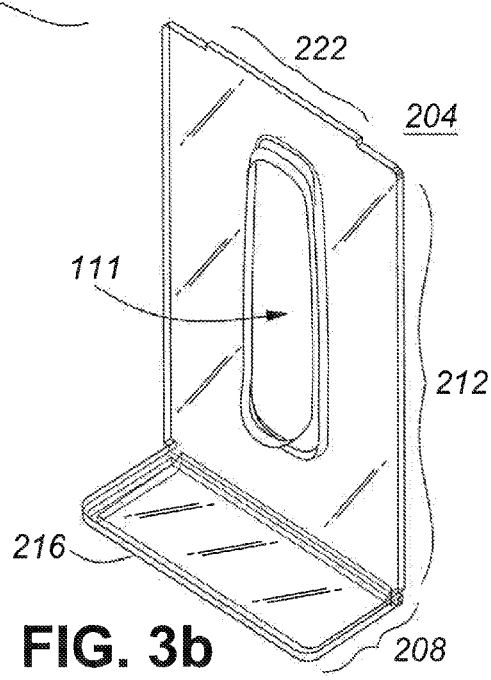

In another embodiment and illustrated in FIGS. 3*a* and 3*b* a tab formation 220, 222 is formed at the top edge of the planar upright portions 210, 212 of the L-shaped inserts 202, 204. The tabs 220, 222 serve to register the inserts on the shells 106, 108 and to allow a compressive force to be applied to the inserts to maintain the device firmly within the aperture. Accordingly in this embodiment one of the shells 106 has a portion of its ledge removed to allow the tab 220 of one of the inserts 202 to abut the surface of the shell edge in this removed portion as shown in the assembly 500 of FIG. 5*a*. The tab 222 of the other insert 204 is arranged to abut the seat of the ledge of the other shell 108 as shown in the assembly 501 of FIG. 5*b*. Since the seat extends from the inner surface of the shell 108 the ledge does not have to be removed in order to support the tab 222. The edges, particularly in this region, exert a compressive force on the tab sections 220 and 222 from opposing directions to compress the inserts 202, 204 together. The compression of the inserts in turn exerts an opposing compressive force at the periphery of the device 102 at the aperture edges to thereby retain or "float" the device within the enclosure 104. The base portions are also held in compression by the assembled shells which indirectly hold the device in compression between the inserts.

In an embodiment, the shells 106, 108 are assembled and held together by an adhesive security seal made of a pliable material applied to the bottom surface 125 and a pliable material with a hanger 126 applied to the top surface of the enclosure. The hanger may be foldable against a surface of the container 100 or absent.

In another embodiment the container may be assembled from front and back shells having integrally formed inserts so that when the front and back shells fit together the device is trapped between the inserts of the respective shells.

In a still further embodiment the inserts may not include a base portion, but simply comprise the upright portions.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

The invention claimed is:

1. A packaging container for a device comprising:

an enclosure assembled from separable front and back transparent shells the assembled shells defining a cavity for housing the device; and a transparent insert having opposing front and back surfaces and a perimeter surface extending between the front and back surfaces and the perimeter surface defining an outer edge of the insert, the insert configured with the outer edges abutting at least three inner walls of the enclosure, and with the front and back surfaces in a spaced relationship to the inner walls of enclosure and the insert comprising a pair of inserts, each having a single aperture conformed to a silhouette of the device, the aperture including flanged edges to engage and retain the device around its periphery and in a spaced relationship from all inner walls of said cavity so that at least a back, front, top and sides of the device may be directly viewed within the cavity without visual obstruction, wherein the pair of inserts is comprised of L-shaped members having a planar base portion and planar upright portion, the base portion include rail formations formed to extend from a surface of respective ones of three edges of the base portion for engaging corresponding grooves formed on inner front, back and side walls of the enclosure shell.

2. The packaging as defined in claim 1, the flanged edges forming a groove when said pair of inserts are abutted.

3. The packaging as defined in claim 1, wherein outer edges of the insert are aligned with a seam formed at an interface between the assembled shells.

4. The packaging as defined in claim 1, wherein the respective apertures are formed in the upright portion.

5. The packaging as defined in claim 4, wherein the planar base portion is configured to divide said container into an upper compartment defining said cavity for housing the device and a lower compartment for storage.

6. The packaging as defined in claim 5, including a sleeve in an interior of the lower compartment.

7. The packaging as defined in claim 1, the upright portions include tab formations formed at a top edge thereof for overlapping an edge of the shells whereby assembly of the shells exerts a compressive force on the tabs.

8. An insert for a packaging container comprising:

first L-shaped insert having a single first aperture on one portion thereof; and a second L-shaped insert having a single second aperture, the L-shaped inserts having a base portion and an upright portion, the single first and second apertures formed in the upright portion of respective L-shaped inserts and conformed to a silhouette of a device, the apertures being formed with a flange at an edge thereof, the flange for engaging the device around its periphery and retaining the device in a spaced relationship from inner walls of the packaging container when the L-shaped inserts are abutted together, wherein the packaging container includes grooves formed on inner front, back and side walls; and the base portion of the inserts includes rail projections formed to extend from a surface of respective ones of three edges of the base portion the rail projections for engaging the grooves formed on the inner front, back and side walls of the packaging container.

* * * * *